US005465851A

United States Patent [19]

Smith

[11] Patent Number: 5,465,851

[45] Date of Patent: Nov. 14, 1995

[54] SUSPENSION-TYPE DISPLAY STAND

[75] Inventor: Michael J. Smith, Orangeburg, N.Y.

[73] Assignee: Arrow Art Finishers, Inc., Bronx, N.Y.

[21] Appl. No.: 336,773

[22] Filed: Nov. 9, 1994

[51] Int. Cl.[6] ..... A47F 5/00

[52] U.S. Cl. ..... 211/59.1; 211/149; 248/174; 108/162

[58] Field of Search ..... 211/59.1, 57.1, 211/195, 149; 248/174; 108/162

[56] References Cited

U.S. PATENT DOCUMENTS

| | | | |
|---|---|---|---|
| 2,918,178 | 12/1959 | Leone | 211/195 |
| 2,992,745 | 7/1961 | Huff | 211/195 |
| 3,139,192 | 6/1964 | Maguire | 211/149 X |
| 4,151,803 | 5/1979 | Ferrera et al. | 248/174 X |
| 4,311,100 | 1/1982 | Gardner et al. | 211/149 X |
| 4,733,782 | 3/1988 | Spezial et al. | 211/57.1 |
| 4,760,928 | 8/1988 | Bustos | 248/174 X |
| 5,273,169 | 12/1993 | Maglione | 211/149 |
| 5,315,936 | 5/1994 | Smith | 211/149 X |
| 5,316,156 | 5/1994 | Land et al. | 211/149 |

*Primary Examiner*—Robert W. Gibson, Jr.
*Attorney, Agent, or Firm*—Kirschstein et al.

[57] ABSTRACT

An erectable stand for displaying objects includes a generally planar back panel and at least one mounting flap that is hinged to the back panel. At least one separate peg is mounted on the mounting flap such that its suspending portion projects past an exposed edge portion of the flap. The flap is substantially coplanar with the back panel and the peg is situated adjacent the back panel in a collapsed position of the flap, while in an erected position the exposed edge portion of the flap is remote from the back panel and the peg projects generally perpendicularly of the back panel. The mounting flap and peg are kept in the erected position while the stand is in use for maintaining at least one object suspended from the suspending portion of the peg.

10 Claims, 3 Drawing Sheets

SUSPENSION-TYPE DISPLAY STAND

BACKGROUND OF THE INVENTION

1. Field of the Invention

The present invention relates to arrangements for displaying objects in general, and more particularly to a display stand operative for displaying objects in a suspended fashion.

2. Description of the Related Art

Various constructions of arrangements for displaying a variety of diverse objects are already known, among them such that are easily erectable from a substantially flat storage and transportation position into an unfolded position of use. An example of a display arrangement of this type is disclosed in a commonly owned U.S. Pat. No. 5,315,936, wherein the shape of the arrangement or stand in its unfolded condition is reminiscent of a multi-shelf bookcase. Exposed (front) edge regions of the individual shelves incorporate shaped wire structures which include hook-shaped projections that engage around adjacent edge regions of respective side panels of the display stand to lock the shelves in place. In use, the shelves extend substantially horizontally to provide ready and reliable support for any articles or objects that are placed thereon. Similar display stand constructions, with horizontal shelves or pockets, and with or without locking, reinforcing, or supporting wire structures, are also disclosed in U.S. Pat. Nos. 2,918,178, 2,992,745 and 5,273,169.

However, not all articles display well when supported in this fashion; rather, many items or substances are currently shaped or packaged in such a manner as to present their most attractive sides or most alluring images when stored and/or displayed in retail establishments or the like in a suspended fashion. In view of this, whole sections of store shelving have been replaced by pegboard or similar structures that carry variously configured pegs that extend substantially horizontally frontwardly (i.e toward the potential observer or customer) from the pegboard panels. The articles to be displayed are then suspended from the pegs, with the pegs usually passing through holes provided substantially centrally in the upper regions of the articles or objects in question. Of course, such permanent structures are rather bulky and expensive and hence not suited for temporary displays (such as of articles on sale) or in other circumstances where the expense of the permanent pegboard-style display stand is not warranted, where space is at a premium so that any unused display stands must be removed, or where the amount of space occupied by and/or the weight of the display stand while in transit are important considerations.

Collapsible lightweight display stands like those mentioned above would be ideal for these purposes. Unfortunately, not only are the collapsible display stands discussed above and/or their wire structures, if any, totally unsuited for holding the objects on display in any other manner than on their shelves or in their pockets, but the above patents are devoid of any indication not only as to how the above structures could be modified to be able to carry suspended display objects, but even that such modifications should be made in the first place and why.

SUMMARY OF THE INVENTION

OBJECTS OF THE INVENTION

Accordingly, it is a general object of the present invention to avoid the disadvantages of the prior art.

More particularly, it is an object of the present invention to provide a display arrangement that does not possess the drawbacks of the known arrangements of this type.

Still another object of the present invention is to devise a display stand of the type here under consideration which is suited for supporting articles or objects to be displayed in a suspended fashion.

It is yet another object of the present invention to design the above display stand in such a manner as to be lightweight and easily erectable and collapsible.

A concomitant object of the present invention is so to construct the display stand of the above type as to be relatively simple in construction, inexpensive to manufacture, easy to use, and yet reliable and quite sturdy in operation.

FEATURES OF THE INVENTION

In keeping with the above objects and others which will become apparent hereafter, one feature of the present invention resides in an erectable stand for displaying objects in a suspended fashion. The display stand includes a generally planar back panel and at least one mounting flap having an exposed edge portion. In accordance with the present invention, there is provided at least one peg separate from and mounted on the mounting flap. The peg has a suspending portion projecting past the exposed edge portion of the flap for suspending at least one object therefrom. The display stand further includes means for connecting the mounting flap to the back panel for movement relative thereto between a collapsed position in which the mounting flap is substantially coplanar with the back panel and the peg is situated adjacent the back panel, and an erected position in which the exposed edge portion is remote from the back panel and the peg projects generally perpendicularly of the back panel. Means are further provided for jointly moving the mounting flap and peg between their collapsed and erected positions, and for keeping the mounting flap and peg in their erected position for maintaining the object suspended from the suspending portion of the peg when the stand is in use.

A particular advantage of the display arrangement or stand as described so far is that any object to be displayed can be suspended from the respective peg when the stand is in its erected position, so long as the appearance of the object is suited and the object is configured for display in this fashion, that is, provided that the object includes an opening or a similar formation by means of which the object can be engaged with the suspending portion of the peg to pend down therefrom and that the object is not so heavy that it would deform or move the mounting portion to such an extent that the object would slide off of the peg which would no longer be generally perpendicular of the back panel under these circumstances. It is not difficult to satisfy these criteria because a whole plethora of packages containing relatively small items, such as needles, buttons or other sewing notions, or other relatively lightweight articles is available from various manufacturers to choose from.

In a particularly advantageous construction of the erectable stand of the present invention, the moving means includes a pair of side panels each integral with and hinged to one side of the back panel for movement relative thereto between its collapsed position in which it is coplanar with the back panel and its erected position in which it extends substantially normal to the back panel, and means for supporting the mounting flap on the side panels for movement from the collapsed condition to the erected position as the side panels simultaneously move from their collapsed to their extended positions. In this context, it is further advantageous when the supporting means includes a pair of supporting portions each hingedly connected to the mounting flap and to the respective one of the side panels and partially separated from the latter by a substantially V-shaped cut to be received in the respective side panel in the collapsed position of the latter and to cause the mounting portion to move towards its erected position as the respective supporting portion pivots relative to the respective side panel during the movement of the latter towards its erected position.

According to another advantageous aspect of the present invention, the peg further includes at least one inserting portion that is inserted into the exposed edge portion of the mounting portion. Then, it is also advantageous when at least the mounting portion is of a corrugated cardboard having two external skins and internal corrugations inbetween, and when the inserting portion of the peg is accommodated and confined between one of the external skins and the internal corrugations.

Another advantageous feature of the present invention resides in the keeping means being constituted by a confining member including at least a pair of side walls, and a top and a bottom wall interconnecting the top and bottom walls and keeping them at such a distance from one another as to tightly confine the side panels in their erected positions. Then, the confining member may further include a back wall spanning the space between the side, top and bottom walls to serve as a rear abutment for the back panel.

The erectable stand of the present invention advantageously further includes a reinforcing portion connected to the mounting portion for tilting relative thereto between a first position in which it is aligned with the mounting portion and thus denies access to the exposed edge portion of the latter, and a second position in which it gives such access for the mounting of the peg on the mounting portion and transfers the neutral axis by a predetermined distance vertically away from the mounting portion. The reinforcing portion may have at least one cutout at its juncture with the mounting portion for further facilitating the access to the edge portion of the mounting portion. It is particularly advantageous when the reinforcing portion is displaced upwardly relative to the mounting portion in its second position because then it is unlikely to interfere with the objects suspended from the peg.

The novel features which are considered as characteristic of the invention are set forth in particular in the appended claims. The invention itself, however, both as to its construction and its method of operation, together with additional objects and advantages thereof, will be best understood from the following description of specific embodiments when read in connection with the accompanying drawing.

DETAILED DESCRIPTION OF THE PREFERRED EMBODIMENT

Figure 1:
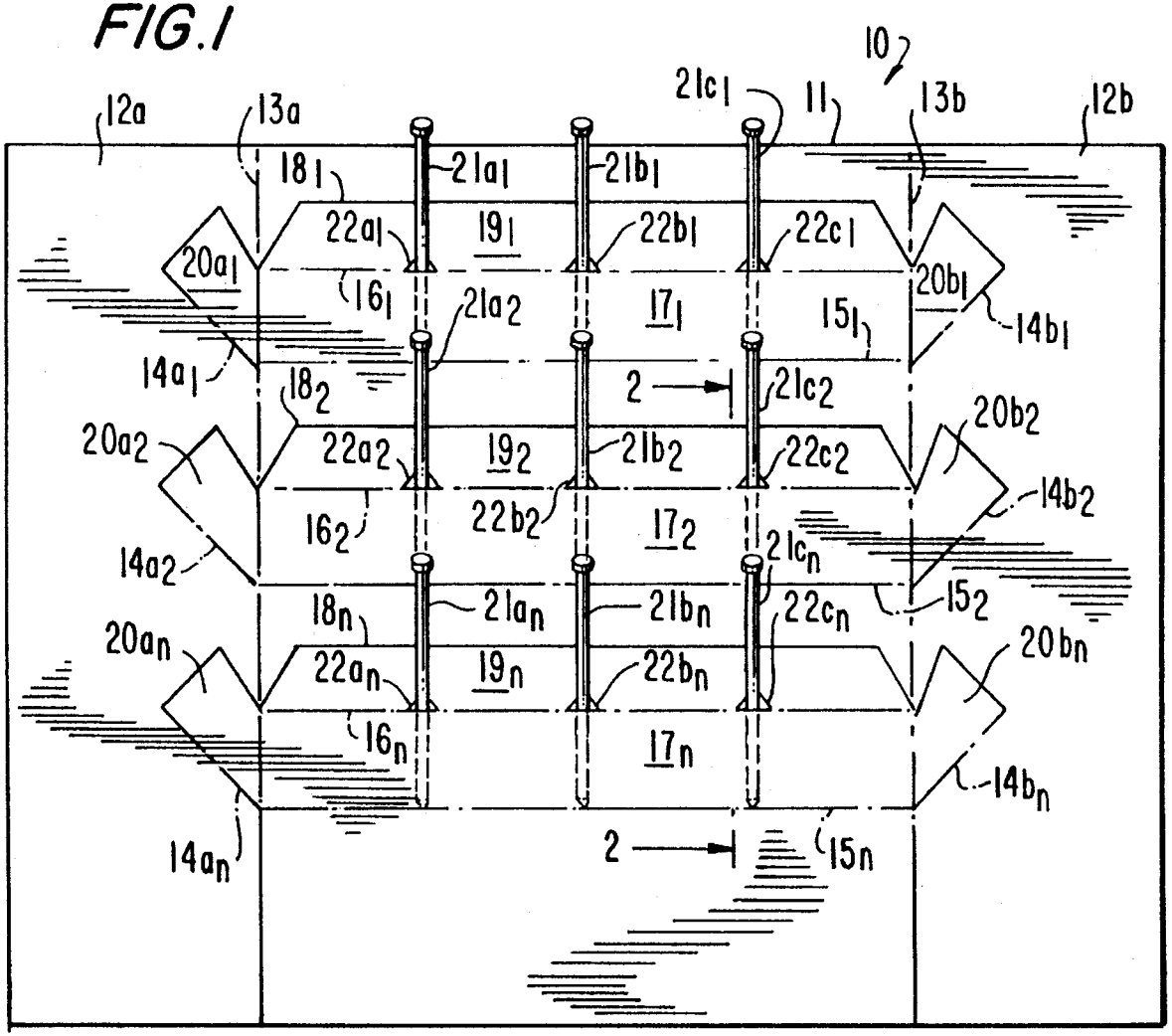
FIG. 1 is a front elevational view of a main component of a display stand of the present invention in its collapsed position.

Referring now to the drawing in detail, and first to FIG. 1 thereof, it may be seen that the reference numeral 10 has been used therein to identify a main component of a display stand of the present invention in its entirety. The main component 10 is shown there, as well as in FIG. 2, in its substantially planar collapsed state in which it occupies only a very small amount of space and can be easily stacked with other such collapsed display stand components for storage or transportation.

Figure 2:
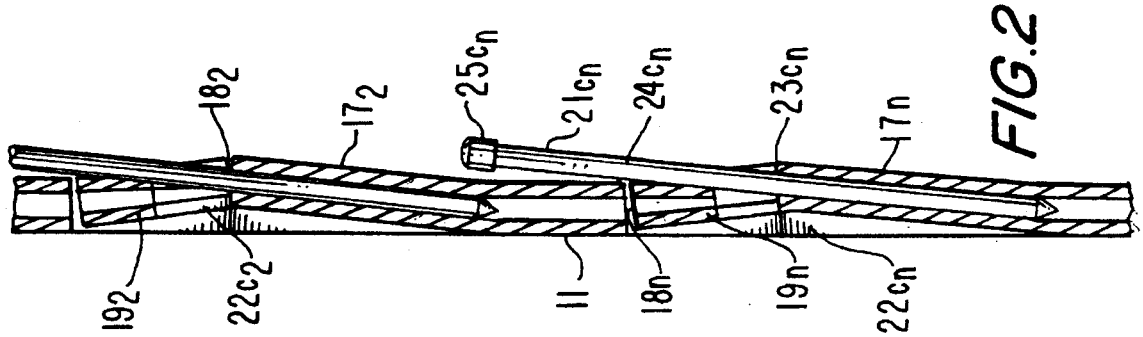
FIG. 2 is a cross-sectional view taken on line 2—2 of FIG. 1.

As a comparison of FIGS. 1 and 2 will reveal, the main display stand component 10 has a configuration of a generally rectangular sheet of a material strong enough to be able to sustain not only its own weight but also that of any items to be carried thereby, as well as withstand the action of any reasonably expected external forces to which it may be subjected while being handled or used, without undesirably buckling, bending or collapsing. Corrugated cardboard has been found to satisfy the above requirements as well as others that will become apparent later, and hence the invention will be described as embodied in a display stand using this material for its main component 10.

The main component 10 includes a back panel 11 and two side panels 12*a* and 12*b*. In this connection, it is to be mentioned that all indications given herein with respect to directions (e.g. front, rear, side, up, down, etc.) are to be understood to relate to the orientation of the main component 10 and other components of the display stand of the present invention as assumed during their actual use, and as seen by a potential observer, especially a store patron, viewing any objects on display on the display stand. In the illustrated construction, the side panels 12*a* and 12*b* are integral (i.e. of one piece) with the back panel 11, and are joined to the latter by respective crease lines or hinge portions 13*a* and 13*b*. The crease lines 13*a* and 13*b* constitute weakened portions of the main component 10 and enable the respective side panels 12*a* and 12*b* to be turned about them relative to the back panel 11 between the collapsed position of FIG. 1 and the erected position indicated in FIG. 4 of the drawing.

Besides the crease lines 13*a* and 13*b*, the main component 10 is further provided with auxiliary crease lines $\mathbf{14}a_1$ to $\mathbf{14}a_n$ and $\mathbf{14}b_1$ to $\mathbf{14}b_n$ (with n denoting herein any suitably chosen number, such as three as shown) that extend from the respective crease lines 13*a* and 13*b* upwardly, as shown at an angle of substantially 45°, onto the respective side panels 13*a* and 13*b*. Further crease lines $\mathbf{15}_1$ to $\mathbf{15}_n$ are provided, connecting the respective junctures of the crease line 13*a* with the crease lines $\mathbf{14}a_1$ to $\mathbf{14}a_n$ with corresponding junctures of the crease line 13*b* with the crease lines $\mathbf{14}b_1$ to $\mathbf{14}b_n$. Additional crease fines $\mathbf{16}_1$ to $\mathbf{16}_n$ extend between the crease fines 13*a* and 13*b* substantially parallel to the crease lines $\mathbf{15}_1$ to $\mathbf{15}_n$ and delimit respective mounting portions $\mathbf{17}_1$ to $\mathbf{17}_n$ therewith.

Zig-zagging cuts $\mathbf{18}_1$ to $\mathbf{18}_n$, the courses of which are clearly visible in FIG. 1 of the drawing so that they need not be described herein in any detail, partly separate the respective ones of the mounting portions $\mathbf{17}_1$ to $\mathbf{17}_n$ and of associated reinforcing portions $19_1$ to $19_n$ that adjoin the mounting portions $17_1$ to $17_n$ along the additional crease lines $16_1$ to $16_n$ from the remainder of the back panel 11, as well as respective supporting portions $20a_1$ to $20a_n$ and $20b_1$ to $20b_n$, which are further delimited by the crease lines 13*a* or 13*b* and $14a_1$ to $14a_n$ or $14b_1$ to $14b_n$, from the respective side panels 12*a* or 12 *b*. The cuts $18_1$ to $18_n$ make it possible to tilt the respective mounting portions or flaps $17_1$ to $17_n$, together with the associated reinforcing portions $19_1$ to $19_n$, out of the plane of the back panel 11, tilting them around the respective crease lines $15_1$ to $15_n$ and $16_1$ to $16_n$, while simultaneously moving the supporting portions $20a_1$ to $20a_n$ and $20b_1$ to $20b_n$ about the associated crease lines $14a_1$ to $14a_n$ or $14b_1$ to $14b_n$, out of the planes of the respective side panels 12*a* or 12*b*.

Each of the mounting portions or flaps $17_1$ to $17_n$ is shown in FIGS. 1 and 2 of the drawing to carry a plurality of (as shown three) discrete pegs $21a_1$ to $21c_1$, $21a_2$ to $21c_2$, or $21a_n$ to $21c_n$, respectively. As illustrated, the pegs $21a_1$ to $21c_1$, $21a_2$ to $21c_2$, and $21a_n$ to $21c_n$ are configured as pins or nails; however, they could also have configurations different from that, such as being substantially U-shaped with each of the substantially parallel legs of the U being mounted on the respective mounting flap $17_1$ to $17_n$ in a manner identical or similar to that which will now be discussed.

As shown in FIG. 1, each of the reinforcing portions $19_1$ to $19_n$ is provided with a plurality of triangular cutouts $22a_1$ to $22c_1$, $22a_2$ to $22c_2$, and $22a_n$ to $22c_n$ that border on the respective crease lines $16_1$ to $16_n$ so as to make accessible or expose selected zones of the respective edge regions or portions of the respective mounting flaps $17_1$ to $17_n$ by tilting the reinforcing portions $19_1$ to $19_n$ out of the planes of the associated mounting flaps $17_1$ to $17_n$. As shown, this relative tilting takes place in the upward direction, making the affected edge region zones accessible from underneath the respective reinforcing portions $19_1$ to $19_n$.

As will be discussed in conjunction with FIG. 2 of the drawing using the peg $21c_n$ as a representative of all others, each of the pegs $21a_1$ to $21c_1$, $21a_2$ to $21c_2$, and $21a_n$ to $21c_n$ includes an inserting end portion $23c_n$, shown to be provided with a pointed tip, and a suspending end portion $24c_n$ shown to have an enlarged head $25c_n$. In the illustrated embodiment, where the main display stand component 10 is of corrugated cardboard as already mentioned before, the inserting end portion $23c_n$ is introduced to a predetermined depth into one of the voids existing between the outer skins and the internal corrugations of the cardboard, so that the suspending end portion $24c_n$ projects past or beyond the affected edge region of the mounting flap $17_n$. It may also be seen in FIG. 2 that in the collapsed condition of the main component 10 illustrated there, the mounting portion $17_n$ (as well as the reinforcing portion $19_n$) is essentially coplanar with the remainder of the main component 10, and the suspending end portion $24c_n$ of the peg $21c_n$ is situated adjacent the back panel 11, so that the whole assembly occupies only a minimum amount of space only insignificantly exceeding that of the main component 10 proper.

Figure 3:
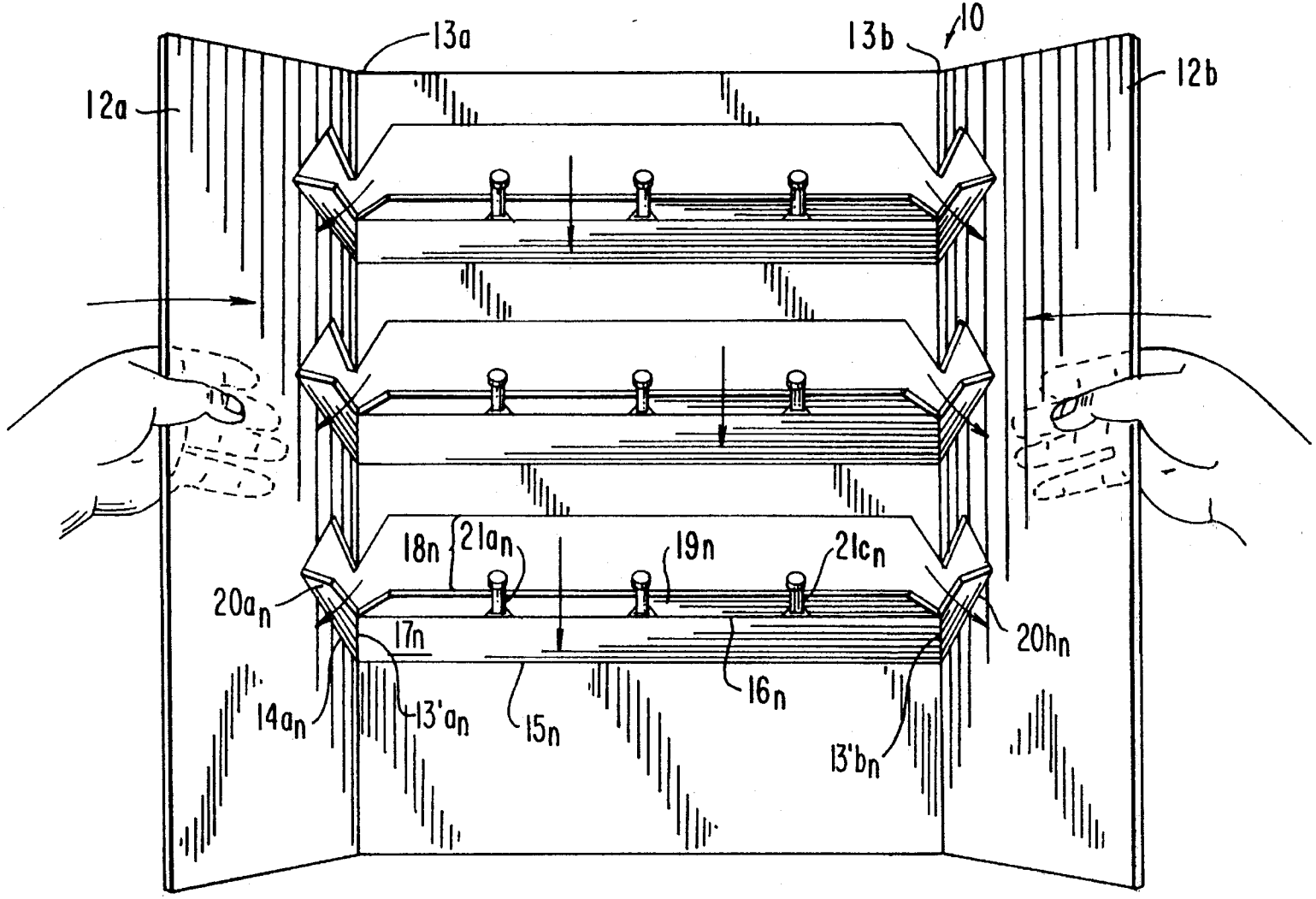
FIG. 3 is a view similar to that of FIG. 1 but showing the main component of the display stand as it is moved from its collapsed towards its erected position.

Turning now to FIG. 3 of the drawing, it may be seen that it depicts a stage in the transition from the collapsed state to the aforementioned erected state of the main component 10 of the display stand of the present invention, with only a few representative reference numerals being used therein in order not to unduly encumber the drawing. A store clerk or similar user employs his or her hands to simultaneously pivot the side panels 12*a* and 12*b* about the respective crease lines 13*a* and 13*b* relative to the back panel 11 in the directions indicated by respective arrows, that is, in the frontward directions. Concurrently with and as a result of this movement of the side panels 12*a* and 12*b*, the supporting portions such as $20a_n$ and $20b_n$ dissociate themselves from the respective side panels 12*a* and 12*b* and conduct movements relative thereto about the associated crease lines $14a_n$ and $14b_n$, thus pushing the associated mounting flap $17_n$ into turning down and frontwardly away from the remainder of the back panel 11, with the pegs such as $21a_n$ and the associated supporting portion $19_n$ moving jointly or in tandem therewith, thus widening the cut or gap $18_n$. Such movements, which are indicated in FIG. 3 by respective arrows, are continued until the side panels 12*a* and 12*b* extend substantially normal to the back panel 11, at which point the erected condition of the main component 10 is reached. For these movements to proceed smoothly, it may be necessary at least initially to train or help respective sections such as $13'a_n$ and $13'b_n$ of the crease lines 13*a* and 13*b* to buckle frontwardly, that is oppositely to the remaining sections, but such purposeful action will usually be unnecessary in view of the fact that the presence of the pegs such as $21a_n$, and particularly that of their suspending end portions such as $24c_n$ in front of the back panel 11 in the collapsed condition, by itself may already introduce a certain bias causing the affected portions such as $17_n$, $20a_n$ and $20b_n$ to preferentially buckle in this manner.

Figure 4:
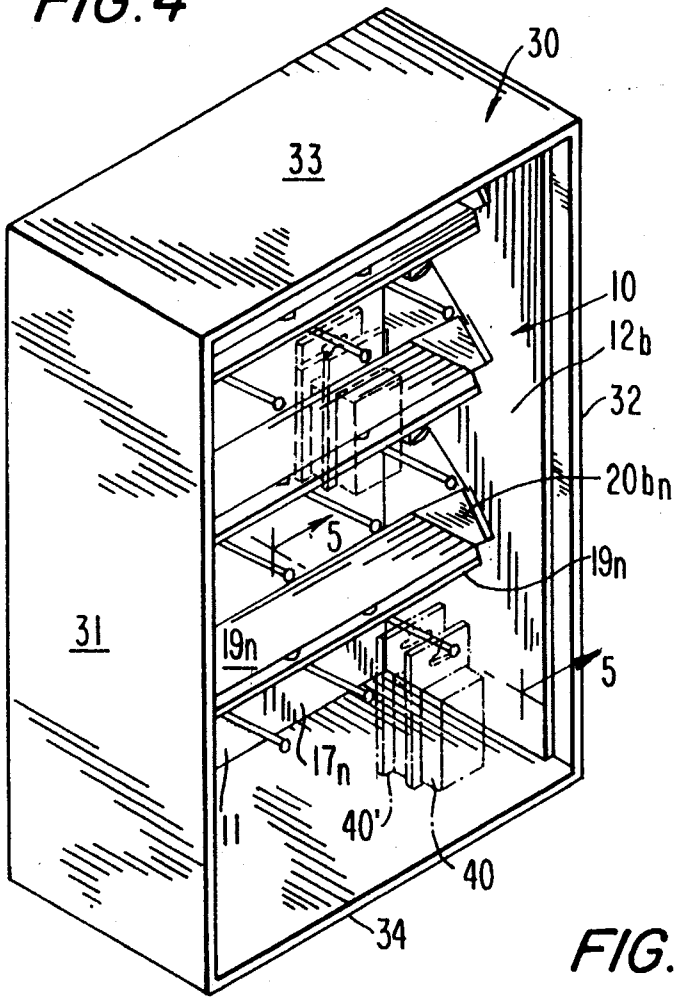
FIG. 4 is a perspective view of the main component of the display stand of FIGS. 1 and 3 as confined in its fully erected position within an outer holding component.

Obviously, the side panels 12*a* and 12*b* must be kept in position if the display stand is to be used lest they revert to the collapsed state or an intermediate state in which the stand is unusable. To this end, the display stand further includes a confining structure or component 30 that is shown in FIG. 4 of the drawing. The component 30 includes at least two side walls 31 and 32 and top and bottom walls 33 and 34 that interconnect the side walls 31 and 32. The walls 31 to 34 circumferentially bound a confining space dimensioned to rather snugly receive the main component 10 in its erected condition, with the side panels 12*a* and 12*b* (only the latter visible in FIG. 4) adjoining the side walls 31 and 32 and being kept by them in their erected positions relative to the back panel 11. Obviously, the top and bottom walls 33 and 34 prevent the side walls 31 and 32 from moving apart and thus releasing the side panels 12*a* and 12*b* for movement toward their collapsed positions. On the other hand, sliding displacement of the still erected main component 10 out of the confining space of the auxiliary or holding component 30 would free the side panels 12*a* and 12*b* for such movements; yet, such displacement in most instances can happen only as a result of a deliberate action on the part of the store personnel or another user, such as when it is desired to dismantle the display stand.

Figure 5:
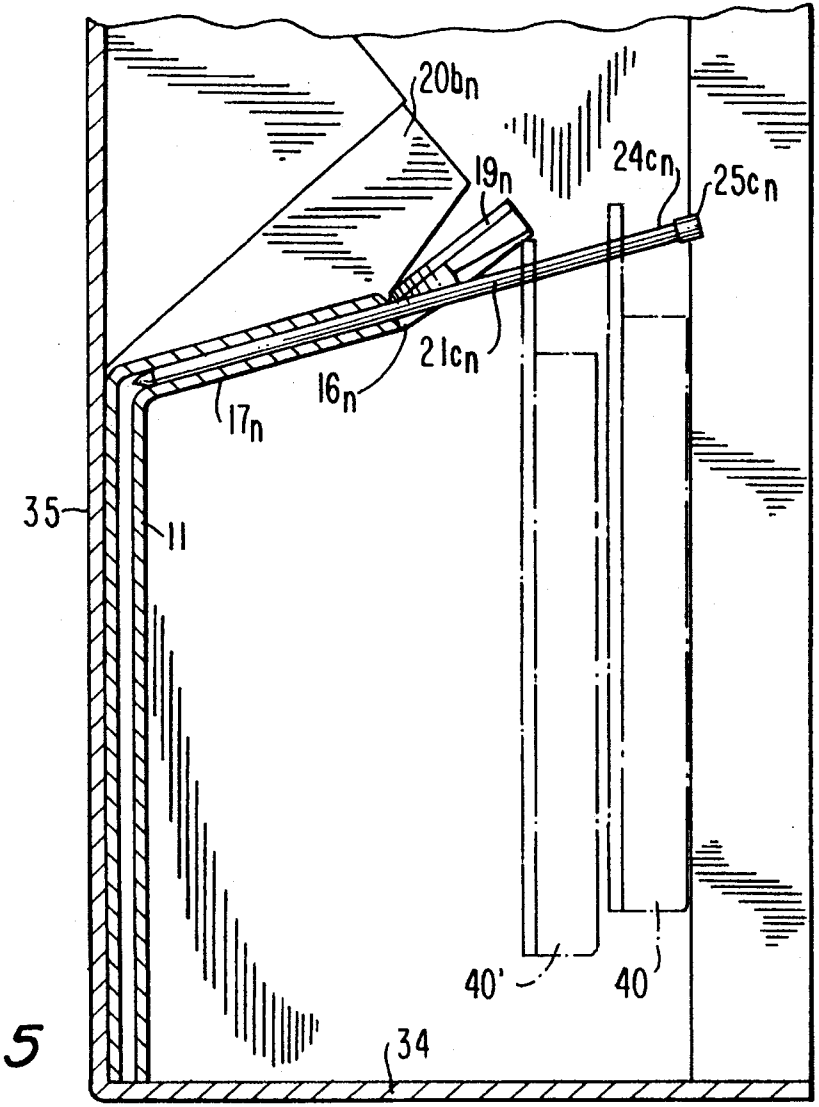
FIG. 5 is a cross-sectional view akin to that of FIG. 2 but taken along the line 5—5 of FIG. 4.

As depicted especially in FIG. 5 of the drawing, the representative mounting flap $17_n$, and with it the suspending portion such as $24c_n$ of the associated peg $21c_n$ advantageously has a slight upward slant as considered in the frontward direction when the display stand assumes its erected condition of use. This measure, together with the presence of the enlarged head $25c_n$ at the free end of the suspending portion $24c_n$ makes it almost impossible for an article such as 40 or 40' hanging on the affected suspending portion $24c_n$ to accidentally slide off of the latter; rather, deliberate manipulation of the object 40 by a customer or the like is required for removing the object 40 from the peg $21c_n$ and thus from the display stand 10. The angle of the aforementioned slant is determined by the course of the respective cut such as $18_n$ and of the crease lines such as $14a_n$ and $14b_n$.

FIG. 5 of the drawing also shows that the auxiliary or confining component 30 of the display stand may actually be constituted by a generally tray-shaped receptacle, i.e. a confining structure including, besides the aforementioned walls 31 to 34, a back wall 35 that spans the space between the walls 31 to 34. The presence of this additional wall 35 gives additional stability to the confining component 30 and thus to the display stand in its condition of use, and offers additional security against collapse of the main component 10 following its accidental pushing through the open back of the confining component 30.

It will be understood that each of the elements described above, or two or more together, may also find a useful application in other types of constructions differing from the type described above.

While the present invention has been described and illustrated herein as embodied in a specific construction of a suspension-type display stand, it is not limited to the details of this particular construction, since various modifications and structural changes may be made without departing from the spirit of the present invention. So, for instance, the reinforcing portions $\mathbf{19}_1$ to $\mathbf{19}_n$, rather than being upturned relative to the associated mounting flaps $\mathbf{17}_1$ to $\mathbf{17}_n$, could be turned down about the respective crease lines $\mathbf{16}_1$ to $\mathbf{16}_n$. In either event, they offer enhanced stability and strength to the mounting flaps $\mathbf{17}_1$ to $\mathbf{17}_n$ by transferring the neutral axis of the combination either upwardly or downwardly of the respective mounting flap $\mathbf{17}_1$ to $\mathbf{17}_n$, thus reinforcing the latter against bending downwardly or sagging under its own weight and/or that of the pegs $\mathbf{21}a_1$ to $\mathbf{21}c_n$ and any articles or objects such as 40 suspended therefrom when the display stand is in its erected position. Also, the cutouts $\mathbf{22}a_1$ to $\mathbf{22}c_n$ could have other than triangular configuration, so long as they provide unimpeded access to the edge regions in question.

Without further analysis, the foregoing will so fully reveal the gist of the present invention that others can by applying current knowledge, readily adapt it for various applications without omitting features that, from the standpoint of prior art, fairly constitute essential characteristics of the genetic or specific aspects of this invention and, therefore, such adaptations should and are intended to be comprehended within the meaning and range of equivalence of the following claims.

What is desired to be protected by Letters Patent is set forth in the appended claims.

I claim:

1. An erectable stand for displaying objects, comprising:

a) a generally planar back panel;

b) at least one mounting flap having an exposed edge portion;

c) at least one peg separate from and mounted on said mounting flap and having a suspending portion projecting past said exposed edge portion for suspending at least one object therefrom;

d) means for connecting said mounting flap to said back panel for movement relative thereto between a collapsed position in which said mounting flap is substantially coplanar with said back panel and said peg is situated adjacent said back panel, and an erected position in which said exposed edge portion is remote from said back panel and said peg projects generally perpendicularly of said back panel;

e) means for jointly moving said mounting flap and peg between said collapsed and erected positions thereof; and f) means for keeping said mounting flap and peg in said erected position thereof for maintaining the object suspended from said suspending portion of said peg when the stand is in use.

2. The erectable stand as defined in claim 1, wherein said moving means includes a pair of side panels each integral with and hinged to one side of said back panel for movement relative thereto between its collapsed position in which it is coplanar with said back panel and its erected position in which it extends substantially normal to said back panel, and means for supporting said mounting flap on said side panels for movement from said collapsed condition to said erected position as said side panels simultaneously move from said collapsed to said extended positions thereof.

3. The erectable stand as defined in claim 2, wherein said supporting means includes a pair of supporting portions each hingedly connected to said mounting flap and to the respective one of said side panels and partially separated from the latter by a substantially V-shaped cut to be received in the respective side panel in the collapsed position of the latter and to cause said mounting portion to move towards its erected position as the respective supporting portion pivots relative to the respective side panel during the movement of the latter towards its erected position.

4. The erectable stand as defined in claim 1, wherein said peg further includes at least one inserting portion inserted into said exposed edge portion of said mounting portion.

5. The erectable stand as defined in claim 4, wherein at least said mounting portion is of a corrugated cardboard having two external skins and internal corrugations inbetween; and wherein said inserting portion is accommodated and confined between one of said external skins and said internal corrugations.

6. The erecatable stand as defined in claim 2, wherein said keeping means includes a confining member including at least a pair of side walls, and a top and a bottom wall interconnecting said top and bottom walls and keeping them at such a distance from one another as to tightly confine said side panels in said erected position thereof.

7. The erectable stand as defined in claim 6, wherein said confining member further includes a back wall spanning the space between said side, top and bottom walls to serve as a rear abutment for said back panel.

8. The erectable stand as defined in claim 1; and further comprising a reinforcing portion connected to said mounting portion for tilting relative thereto between a first position in which it is aligned with said mounting portion and thus denies access to said exposed edge portion of the latter, and a second position in which it gives such access for the mounting of said peg on said mounting portion and transfers the neutral axis by a predetermined distance vertically away from said mounting portion.

9. The erectable stand as defined in claim 8, wherein said reinforcing portion has at least one cutout at its juncture with said mounting portion for further facilitating said access to said edge portion of said mounting portion.

10. The erectable stand as defined in claim 8, wherein said reinforcing portion is displaced upwardly relative to said mounting portion is said second position thereof.

* * * * *